US010569928B2

(12) United States Patent
Smith

(10) Patent No.: US 10,569,928 B2
(45) Date of Patent: Feb. 25, 2020

(54) REDUCED MATERIAL PACKAGING

(71) Applicant: Pratt Corrugated Holdings, Inc., Conyers, GA (US)

(72) Inventor: Tracy C. Smith, Stone Mountain, GA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 185 days.

(21) Appl. No.: 15/861,914

(22) Filed: Jan. 4, 2018

(65) Prior Publication Data

US 2019/0202596 A1 Jul. 4, 2019

(51) Int. Cl.

| | |
|---|---|
| ***B65D 5/30*** | (2006.01) |
| ***B65D 5/66*** | (2006.01) |
| ***B65D 5/42*** | (2006.01) |
| ***B65D 85/36*** | (2006.01) |
| ***B65D 5/18*** | (2006.01) |

(52) U.S. Cl.

CPC ..... *B65D 5/6664* (2013.01); *B65D 5/18* (2013.01); *B65D 5/4266* (2013.01); *B65D 5/4295* (2013.01); *B65D 5/6658* (2013.01); *B65D 85/36* (2013.01); *B65D 5/30* (2013.01); *B65D 2585/366* (2013.01)

(58) Field of Classification Search

CPC ..... B65D 5/30; B65D 5/301; B65D 5/304; B65D 5/6664; B65D 5/4266; B65D 5/4295; B65D 5/6658; B65D 85/36; B65D 2585/366

USPC ..... 229/906

See application file for complete search history.

(56) References Cited

U.S. PATENT DOCUMENTS

| | | | | |
|---|---|---|---|---|
| 1,104,821 A | | 7/1914 | Morrison | |
| 2,349,364 A | * | 5/1944 | Marshall, Jr. | B65D 5/304 229/120.1 |
| 2,789,750 A | * | 4/1957 | Kramer | B65D 5/26 229/149 |
| 5,381,949 A | * | 1/1995 | Correll | B65D 5/2033 229/148 |
| 5,553,771 A | | 9/1996 | Correll | |
| 5,799,864 A | | 9/1998 | Mertz | |

(Continued)

FOREIGN PATENT DOCUMENTS

GB 2350104 11/2000

OTHER PUBLICATIONS

Globalmarket; Article entitled: "small size pizza box", located at <http://www.globalmarket.com/product-info/small-size-pizza-box-10219446.html>, publicly available prior to Jan. 4, 2018, 8 pgs.

*Primary Examiner* — Justin M Larson

(74) *Attorney, Agent, or Firm* — Taylor English Duma LLP

(57) ABSTRACT

A blank includes a top, the top connected to a first top side tab, a second top side tab, a top front tab, and a back tab; a bottom, the bottom defining at least one connection aperture, the bottom connected to a first bottom side tab, a second bottom side tab, a bottom front tab, and the back tab; the first bottom side tab connected to a first cover tab, the first cover tab connected to a first connection tab; the second bottom side tab connected to a second cover tab, the second over tab connected to a second connection tab; the blank formable into a box by connection of the first connection tab to at least one connection aperture and by connection of the second connection tab to at least one connection aperture.

20 Claims, 11 Drawing Sheets

(56) References Cited

U.S. PATENT DOCUMENTS

| | | | | |
|---|---|---|---|---|
| 6,206,277 | B1 | 3/2001 | Correll | |
| 6,547,125 | B2 * | 4/2003 | Correll | B65D 5/2033 229/110 |
| 8,025,207 | B1 * | 9/2011 | Correll | B65D 5/2033 229/110 |
| 9,290,290 | B2 * | 3/2016 | Carman | B65D 5/0254 |
| 9,434,123 | B2 * | 9/2016 | Carman | B65D 5/0254 |
| 10,364,058 | B2 * | 7/2019 | Wiley | B31B 50/60 |
| 2004/0222276 | A1 * | 11/2004 | Correll | B65D 5/2033 229/110 |
| 2004/0222277 | A1 * | 11/2004 | Correll | B65D 5/2033 229/110 |
| 2004/0222278 | A1 * | 11/2004 | Correll | B65D 5/2033 229/110 |
| 2005/0011939 | A1 | 1/2005 | Angelopoulos et al. | |
| 2016/0137337 | A1 * | 5/2016 | Hsu | B65D 5/304 229/195 |
| 2017/0341803 | A1 * | 11/2017 | Marincola | B65D 81/263 |
| 2019/0202596 | A1 * | 7/2019 | Smith | B65D 5/4266 |

* cited by examiner

REDUCED MATERIAL PACKAGING

TECHNICAL FIELD

This disclosure relates to packaging. More specifically, this disclosure relates to food packaging.

BACKGROUND

Packaging, particularly delivery food packaging, and, more particularly, pizza boxes, are common industrial products with wide customer bases. Current packaging solutions can include a variety of arrangements and accommodations to ensure that the pizza box remains strong and solid. However, many of the arrangements and accommodations waste materials, as a pizza box is often disposable packaging. Wasted materials can result in increased cost to the pizza business and to the consumer who purchases the pizza. Additionally, wasted materials can have environmental impacts.

SUMMARY

A blank includes a top, the top connected to a first top side tab, a second top side tab, a top front tab, and a back tab; and a bottom, the bottom defining a connection aperture, the bottom connected to a first bottom side tab, a second bottom side tab, a bottom front tab, and the back tab; the first bottom side tab connected to a first cover tab, the first cover tab connected to a first connection tab; the second bottom side tab connected to a second cover tab, the second cover tab connected to a second connection tab; the blank formable into a box by connection of the first connection tab to the connection aperture.

A box includes a top, the top connected to a first top side tab, a second top side tab, a top front tab, and a back tab; a bottom, the bottom, the bottom connected to a first bottom side tab, a second bottom side tab, a bottom front tab, and the back tab, the back tab defining a back side of the box, the bottom front tab contacting the top front tab defining a front side of the box, the first bottom side tab contacting the first top side tab defining a first side of the box, the second bottom side tab contacting the second top side tab defining a second side of the box; a connection mechanism defined proximate the front side of the box, the connection mechanism comprising an overlap of material along the front side of the box, wherein the material along the front side of the box defines an area ratio RA wherein RA is at most 2.50.

A method of forming a box from a blank includes obtaining a blank, the blank comprising a top, the top connected to a first top side tab, a second top side tab, a top front tab, and a back tab, a bottom, the bottom defining a connection aperture, the bottom connected to a first bottom side tab, a second bottom side tab, a bottom front tab, and the back tab, and at least one bottom side tab connected to a cover tab, the cover tab connected to a connection tab; arranging the first bottom side tab and the second bottom side tab orthogonal to the bottom; arranging the bottom front tab orthogonal to the bottom; arranging the cover tab in contact with the bottom front tab; inserting the connection tab into the connection aperture; arranging the first top side tab in contact with the first bottom side tab; arranging the second top side tab in contact with the second bottom side tab; arranging the top front tab in contact with the bottom front tab.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
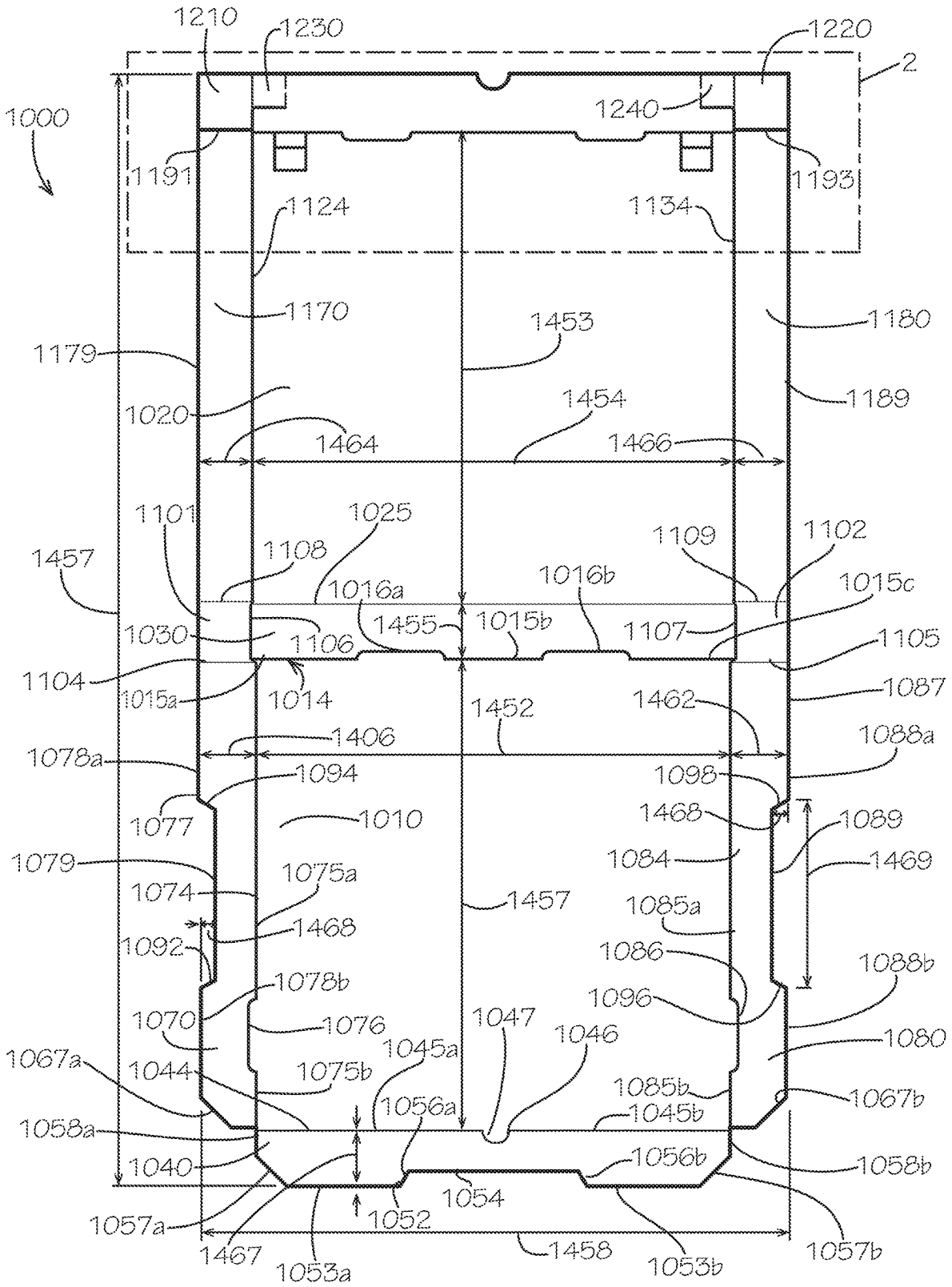
FIG. 1 is a plan view of a blank for forming a box in accord with one aspect of the current disclosure.

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is packaging and associated methods, systems, devices, and various apparatus. The packaging includes a pizza box and a blank for forming a pizza box. It would be understood by one of skill in the art that the disclosed packaging is described in but a few exemplary embodiments among many. No particular terminology or description should be considered limiting on the disclosure or the scope of any claims issuing therefrom.

Disclosed and described with reference to FIG. 1 is a pizza box blank 1000 for formation into a pizza box. The blank 1000 in one aspect can be flat and ready for folding into a pizza box by folding along scorelines and separation along cut lines. Scorelines in the current aspect can be scored, perforated, pre-bent, or otherwise weakened to allow simple bending along a predetermined pattern. Cut lines in the current aspect can be perforated, scored, sliced, pre-cut, or otherwise weakened to allow simple breaking along a predetermined pattern. In various aspects, these features can be altered to achieve the desired plan results for any particular blank, and features of the current blank should not be considered limiting on the scope of the current disclosure.

The blank 1000 can be made from corrugated cardboard, although various materials are also possible, including various paperboards, paper products, plastics, and composite materials. The blank 1000 can comprise a top 1010, a bottom 1020, and a back connection side 1030. The back connection side 1030 can be connected to the bottom 1020 at scoreline 1025, and the back connection side 1030 can be connected to the top 1010 along scoreline 1014. Scoreline 1014 can comprise a first score portion 1015*a*, a second score portion 1015*b*, and a third score portion 1015*c* arranged linearly in the current aspect. Included between the first score portion 1015*a* and the second score portion 1015*b* is a first cut portion 1016*a*; included between the second score portion 1015*b* and the third score portion 1015*c* is a second cut portion 1016*b*. The cut portions 1016 are distinct from the score portions 1015 because the cut portions 1016 are die cut and the score portions 1015 are scored for folding without separating.

Connected to the top 1010 is a top front tab 1040 along scoreline 1044. The scoreline 1044 can comprise a first score portion 1045*a*, a second score portion 1045*b*, and a tab cut portion 1046. In the current aspect, the tab cut portion 1046 can be a semi-circular portion that is cut, whereas other parts of the scoreline 1044 can be scored. A semi-circular feature 1047 defined by the tab cut portion 1046 can remain flat with the top 1010, although various aspects can include various shapes for the tab cut portion or can include no tab cut portion at all. The top front tab 1040 can comprises an end 1052. The end 1052 can include a first extended portion 1053*a* and a second extended portion 1053*b*. Between the extended portions 1053*a,b* is a recessed portion 1054. The recessed portion 1054 is connected to the extended portions 1053*a,b* by transition portions 1056*a,b*, that are angled. The end 1052 also comprises angles 1057*a,b* proximate side edges 1058*a,b* of the top front tab 1040.

Connected to the top 1010 is a first side tab 1070 and a second side tab 1080. The first side tab 1070 can be connected to the top 1010 along scoreline 1074. The scoreline 1074 can comprise a first score portion 1075*a*, a second score portion 1075*b*, and a cut portion 1076. The second side tab 1080 can be connected to the top 1010 along scoreline 1084. The scoreline 1084 can comprise a first score portion 1085*a*, a second score portion 1085*b*, and a cut portion 1086. The first side tab 1070 can comprise an end 1077 that comprises a first extended portion 1078*a*, a second extended portion 1078*b*, and recessed portion 1079. The second side tab 1080 can comprise an end 1087 that comprises a first extended portion 1088*a*, a second extended portion 1088*b*, and recessed portion 1089. The various extended portions can also comprise transition portions 1092, 1094, 1096, 1098 between them. The first side tab 1070 can comprise an angle 1067*a*, and the second side tab can comprise an angle 1067*b*.

A pair of fold tabs 1101, 1102 can be included. Fold tab 1101 can be separated from the first side tab 1070 along cut line 1104 and fold tab 1102 can be separated from the second side tab 1080 along cut line 1105. Fold tab 1101 can be separated from back connection side 1030 along cut line 1106, and fold tab 1102 can be separated from back connection side 1030 along cut line 1107. Fold tab 1101 can be connected to first side tab 1170 along score line 1108. Fold tab 1102 can be connected to second side tab 1180 along score line 1109.

First side tab 1170 can be connected to bottom 1020 along score line 1124. The second side tab 1180 can be connected to the bottom 1020 along score line 1134. In the current aspect, score lines 1124, 1134 are straight, although various aspects can include various shapes in accord with the remaining elements of the disclosure. First side tab 1170 can comprise an end 1179, and second side tab 1180 can comprise an end 1189.

A first cover tab 1210 can be connected to the first side tab 1170 by scoreline 1191. First cover tab 1210 can comprise a contact surface 1212 (shown with reference to FIG. 2). A second cover tab 1220 can be connected to the second side tab 1180 by scoreline 1193. Second cover tab 1220 can comprise a contact surface 1222 (shown with reference to FIG. 2). A first connection tab 1230 can be connected to the first cover tab 1210 and a second connection tab 1240 can be connected to the second cover tab 1220.

Measurements of various portions of the blank 1000 are described as exemplary to provide enablement to one of skill in the art. The various measurements are provided for reference and are not intended to be limiting on the scope of the disclosure. One of skill in the art would understand that packaging can be made of various sizes to accommodate the sizing of the contents, and, as such, the measurements provided are but one aspect among many possible ones.

A length 1451 of the top 1010 is disclosed; in the current aspect, the length 1451 is 16 and ⅛ inches. A width 1452 of the top 1010 is disclosed; in the current aspect, the width 1452 is 16 and ⅛ inches. A length 1453 of the bottom 1020 is disclosed; in the current aspect, the length 1453 is 16 and ¼ inches. A width 1454 of the bottom 1020 is disclosed; in the current aspect, the width 1454 is 16 and ¼ inches. A length 1455 of the back connection side 1030 is disclosed; in the current aspect, the length 1455 is two inches. A width of the back connection side 1030 could be about the same as the width 1452 or the width 1454 or could be larger or smaller depending on the aspect. An overall length 1457 of the blank 1000 is disclosed; in the current aspect, the overall length is 38 and 1/16 inches. An overall width 1458 is disclosed; in the current aspect, the overall width 1458 is 20 and ⅛ inches. A width 1460 of the first side tab 1070 is disclosed; in the current aspect, the width 1460 is two inches. A width 1462 of the second side tab 1080 is disclosed; in the current aspect, the width 1462 is two inches. A width 1464 of the first side tab 1170 is disclosed; in the current aspect, the width 1464 is 1 and 15/16 inches. A width 1466 of the second side tab 1180 is disclosed; in the current aspect, the width 1466 is 1 and 15/16 inches. A length 1467 of the top front tab 1040 is disclosed; in the current aspect, the length 1467 is 2 inches. A depth 1468 of recessed portions 1079, 1089 is disclosed; in the current aspect, both recessed portions 1079, 1089 are the same depth 1468 at ½ inches. A length 1469 of recessed portions 1079, 1089 is disclosed; in the current aspect, both recessed portions 1079, 1089 are the same length 1469 at 6 and ⅜ inches.

Figure 2:
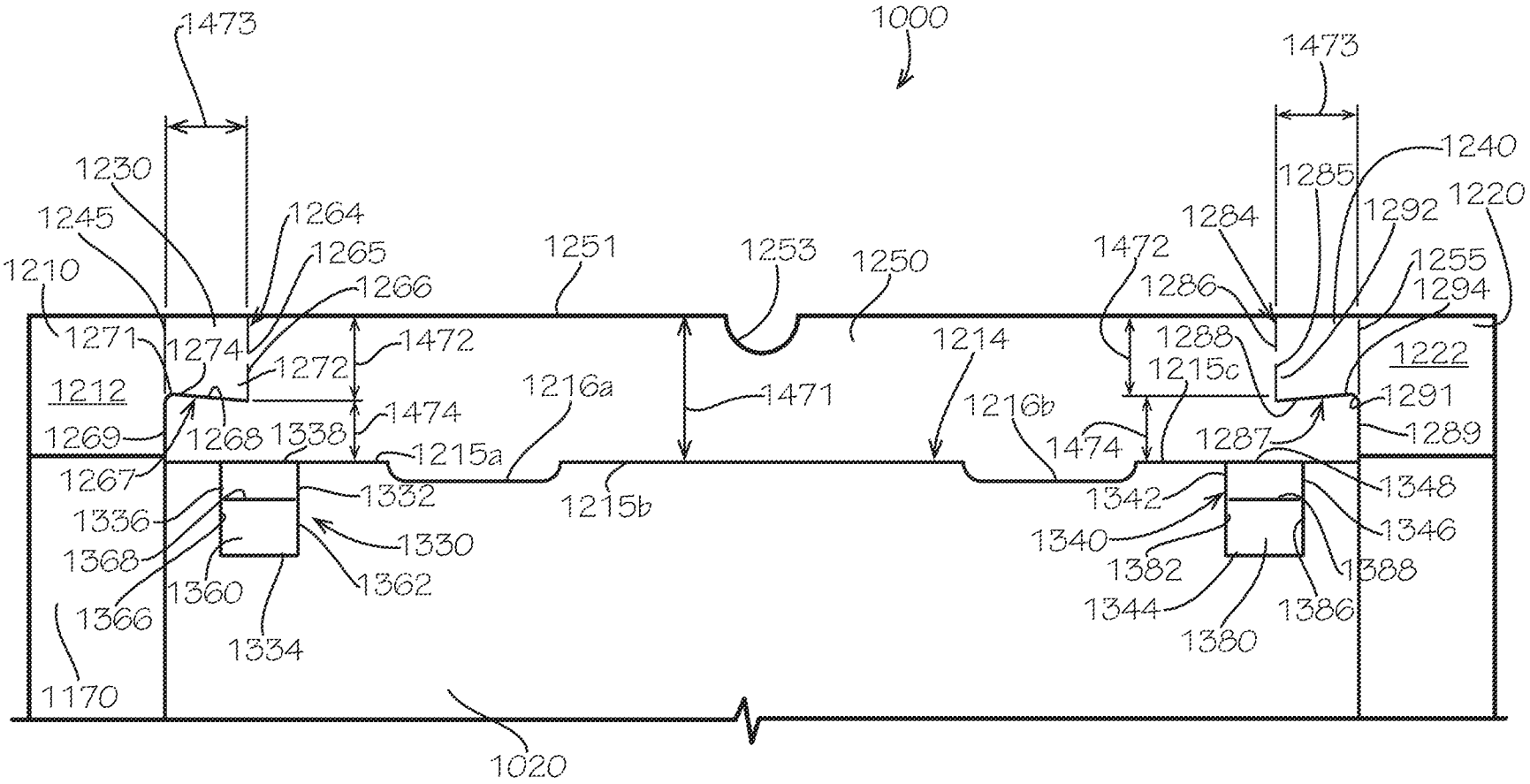
FIG. 2 is a detail view of Detail 2 as annotated in FIG. 1.
Figure 3:
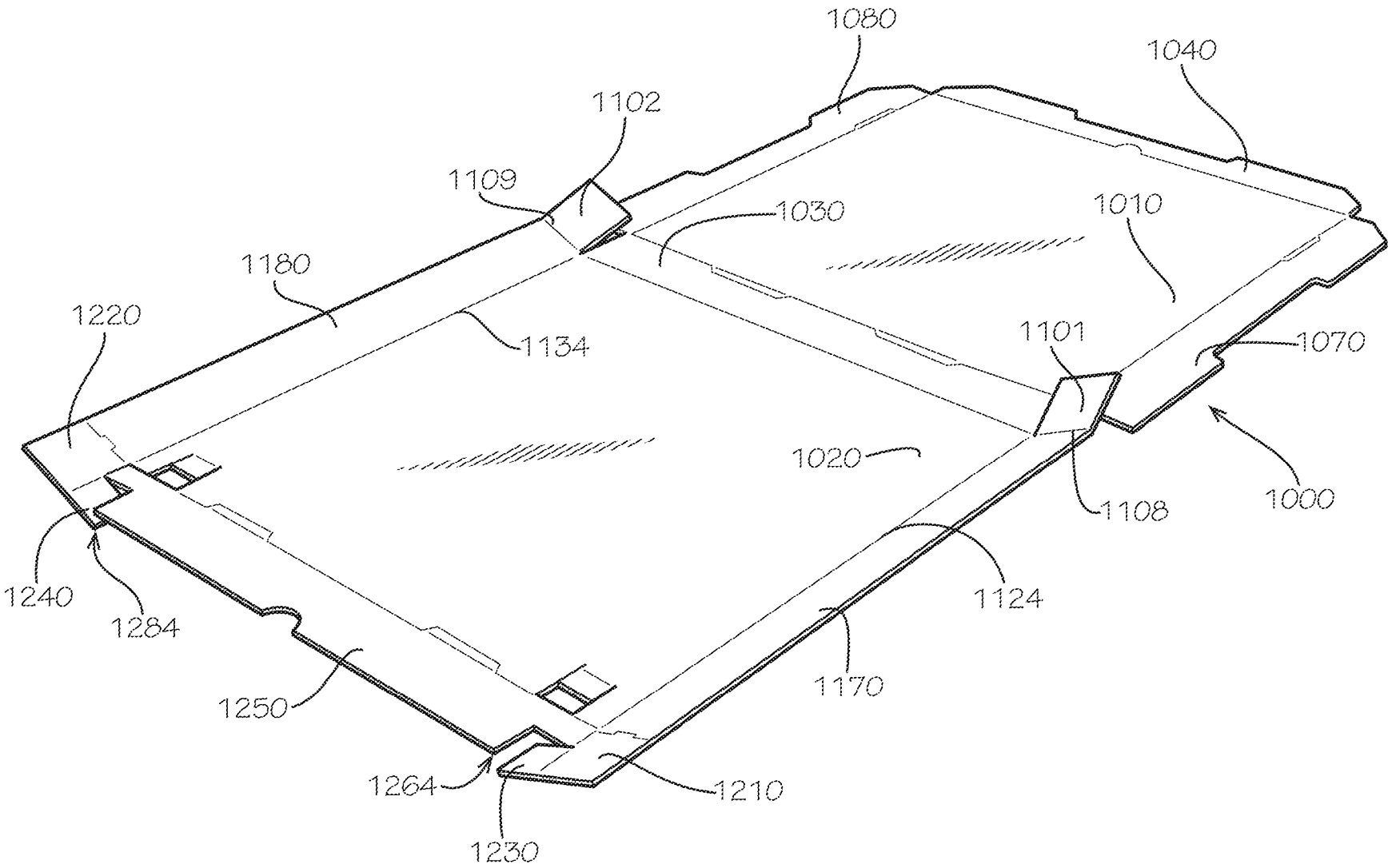
FIG. 3 is a perspective view of the formation of a box from the blank of FIG. 1 in accord with one aspect of the current disclosure.

With reference to the detail view of FIG. 2, the first connection tab 1230 can be connected to the first cover tab 1210 along a scoreline 1245. The second connection tab 1240 can be connected to the second cover tab 1220 along a scoreline 1255.

The first cover tab 1210 and the first connection tab 1230 can abut a bottom front tab 1250 along a cut pathway 1264. The cut pathway 1264 comprises a distal portion 1266 that is about linear in the current aspect, a proximal portion 1269 that is about linear in the current aspect, and a connecting portion 1267. The connection portion 1267 in the current aspect comprises a linear portion 1268 at one end connecting to the distal portion 1266 and a radius 1271 at another end connecting to the proximal portion 1269. It should be noted that many of the connections of elements in the current disclosure are arranged at about a right angle, or orthogonal. However, it should be noted that the linear portion 1268 in the current aspect is arranged at an angle 1272 to the distal portion 1266 that is smaller than 90°, or, in other words, acute. The result of the angle 1272 being acute is that portions of the first connection tab 1230 that are close to the distal portion 1266 are of a larger dimension as measured parallel to the distal portion 1266 than portions of the first connection tab 1230 that are close to the proximal portion 1269. In the current aspect, an end 1265 of the first connection tab 1230 would be the largest dimension as measured parallel to the distal portion 1266. In the current aspect, the first connection tab 1230 has its smallest liner dimension as measured parallel to the distal portion 1266 at a point 1274 of connection between the linear portion 1268 and the radius 1271. It should be noted that, in various aspects, the linear portion 1268 can extend entirely to the proximal portion 1269. In various aspects, the portion of the cut pathway 1264 that is currently the linear portion 1268 can be nonlinear. In various aspects, the angle 1272 can be a right angle. In various aspects, angle 1272 can be obtuse.

Similarly, the second cover tab 1240 and the second connection tab 1220 abut the bottom front tab 1250 along a cut pathway 1284. The cut pathway 1284 comprises a distal portion 1286 that is about linear in the current aspect, a proximal portion 1289 that is about linear in the current aspect, and a connecting portion 1287. The connection portion 1287 in the current aspect comprises a linear portion 1288 at one end connecting to the distal portion 1286 and a radius 1291 at another end connecting to the proximal portion 1289. It should be noted that the linear portion 1288 in the current aspect is arranged at an angle 1292 to the distal portion 1286 that is smaller than 90°, or, in other words, acute. The result of the angle 1292 being acute is that portions of the second connection tab 1240 that are close to the distal portion 1286 are of a larger dimension as measured parallel to the distal portion 1286 than portions of the second connection tab 1240 that are close to the proximal portion 1289. In the current aspect, an end 1285 of the second connection tab 1240 would be the largest dimension as measured parallel to the distal portion 1286. In the current aspect, the second connection tab 1240 has its smallest liner dimension as measured parallel to the distal portion 1286 at a point 1294 of connection between the linear portion 1288 and the radius 1291. It should be noted that, in various aspects, the linear portion 1288 can extend entirely to the proximal portion 1289. In various aspects, the portion of the cut pathway 1284 that is currently the linear portion 1288 can be nonlinear. In various aspects, the angle 1292 can be a right angle. In various aspects, angle 1292 can be obtuse.

The bottom 1020 can be connected to the bottom front tab 1250 along scoreline 1214. The scoreline 1214 can comprise a first score portion 1215*a*, a second score portion 1215*b*, and a third score portion 1215*c*. The scoreline 1216 can also comprise a first cut portion 1216*a* and a second cut portion 1216*b*. As previously discussed with respect to scoreline 1014, scoreline 1214 can comprise portions that define cuts and scores to bend along certain lines and cut apart along other lines. The bottom front tab 1250 can also comprise an end 1251 that can define a recess 1253. The recess 1253 is a semi-circular cutout in the current aspect. The recess 1253 matches tab cut portion 1046 and is intended to be in alignment when the blank 1000 is assembled into a pizza box in the current aspect. However, various aspects may change the arrangement and/or shape of the recess 1253, and various aspects may omit, multiply, or enlarge the recess 1253.

A first connection aperture 1330 can be defined in the bottom 1020. The first connection aperture 1330 is defined by sides 1332, 1334, 1336, 1338. It is noted that side 1338 can be collinear with first score portion 1215*a* such that the first score portion 1215*a* defines one side 1338 of the first connection aperture 1330. In the current aspect, the first connection aperture 1330 is rectangular in shape, although various shapes may be utilized in various aspects. The first connection aperture 1330 can be partially covered by a first aperture cover 1360. In the current aspect, the first aperture cover 1360 can be connected to the bottom 1020 along side 1334, which is a scoreline in the current aspect. A side 1362 can be separated from side 1332 by a cut line, and side 1366 can be separated from side 1336 by a cut line. The first aperture cover 1360 also includes an end 1368. In this aspect, the first aperture cover 1360 can be bent in relation to the bottom 1020 during assembly of a pizza box from blank 1000.

Similarly, a second connection aperture 1340 is defined in the bottom 1020. The second connection aperture 1340 is defined by sides 1342, 1344, 1346, 1348. It is noted that side 1348 is collinear with third score portion 1215*c* such that the third score portion 1215*c* defines one side 1348 of the second connection aperture 1340. In the current aspect, the second connection aperture 1340 is rectangular in shape, although various shapes may be utilized in various aspects. The second connection aperture 1340 can be partially covered by a second aperture cover 1380. In the current aspect, the second aperture cover 1380 is connected to the bottom 1020 along side 1344, which is a scoreline in the current aspect. A side 1382 can be separated from side 1342 by a cut line, and side 1386 can be separated from side 1346 by a cut line. The second aperture cover 1380 also includes an end 1388. In this aspect, the second aperture cover 1380 can be bent in relation to the bottom 1020 during assembly of a pizza box from blank 1000.

Measurements of various portions of the blank 1000 are described. The various measurements are provided for reference and are not intended to be limiting on the scope of the disclosure. A length 1471 of the bottom front tab 1250 is disclosed; in the current aspect, the length 1471 is 1 and 15/16 inches. A dimension 1472 of the connection tabs 1230, 1240 is disclosed; in the current aspect, the dimension 1472 is 1 and 3/16 inches. A dimension 1473 of the connection tabs 1230, 1240 is disclosed; in the current aspect, the dimension 1473 is 1 and 1/8 inches. A length 1474 of an end of the bottom front tab 1250 is disclosed; in the current aspect, the length 1474 is 3/4 inches.

The formation process can be seen with reference to FIGS. 3-9. As seen with reference to FIG. 3, the blank 1000 is initially folded along score lines 1108, 1109. The folding allows the fold tabs 1101, 1102 to break free from back connection side 1030 and from first side tab 1070 and second side tab 1080. Additionally, the first side tab 1170 and the second side tab 1180 are folded along scorelines 1124, 1134 with respect to the bottom 1020, which can cause the cut pathways 1264, 1284 to begin to separate such that the connection tabs 1230, 1240 separate from the bottom front tab 1250 at least partially.

Figure 4:
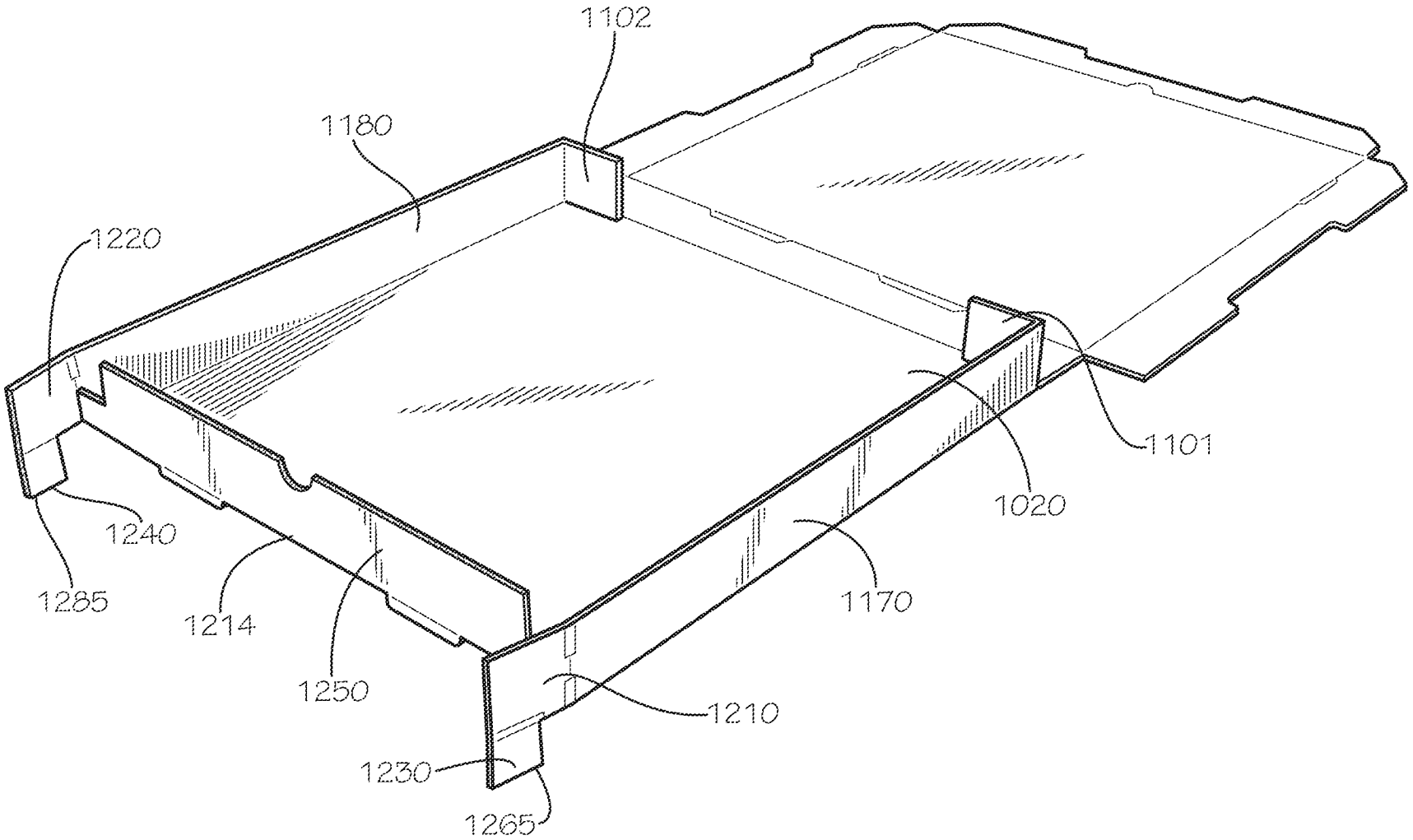
FIG. 4 is a perspective view of the formation of a box from the blank of FIG. 1 in accord with one aspect of the current disclosure.

As seen with reference to FIG. 4, the side tabs 1170, 1180 can be folded with respect to the bottom 1020 such that the side tabs 1170, 1180 are about orthogonal to the bottom 1020. Additionally, the fold tabs 1101, 1102 can be folded such that the fold tabs 1101, 1102 are about orthogonal to both the bottom 1020 and the respective side tab 1170, 1180 to which each fold tab 1101, 1102 is connected. The bottom front tab 1250 can be folded along scoreline 1214 such that the bottom front tab 1250 is about orthogonal in arrangement to bottom 1020. Additionally, the cover tabs 1210, 1220 and the connection tabs 1230, 1240 are shown completely separated from the bottom front tab 1250 along cut pathways 1264, 1268.

Figure 5:
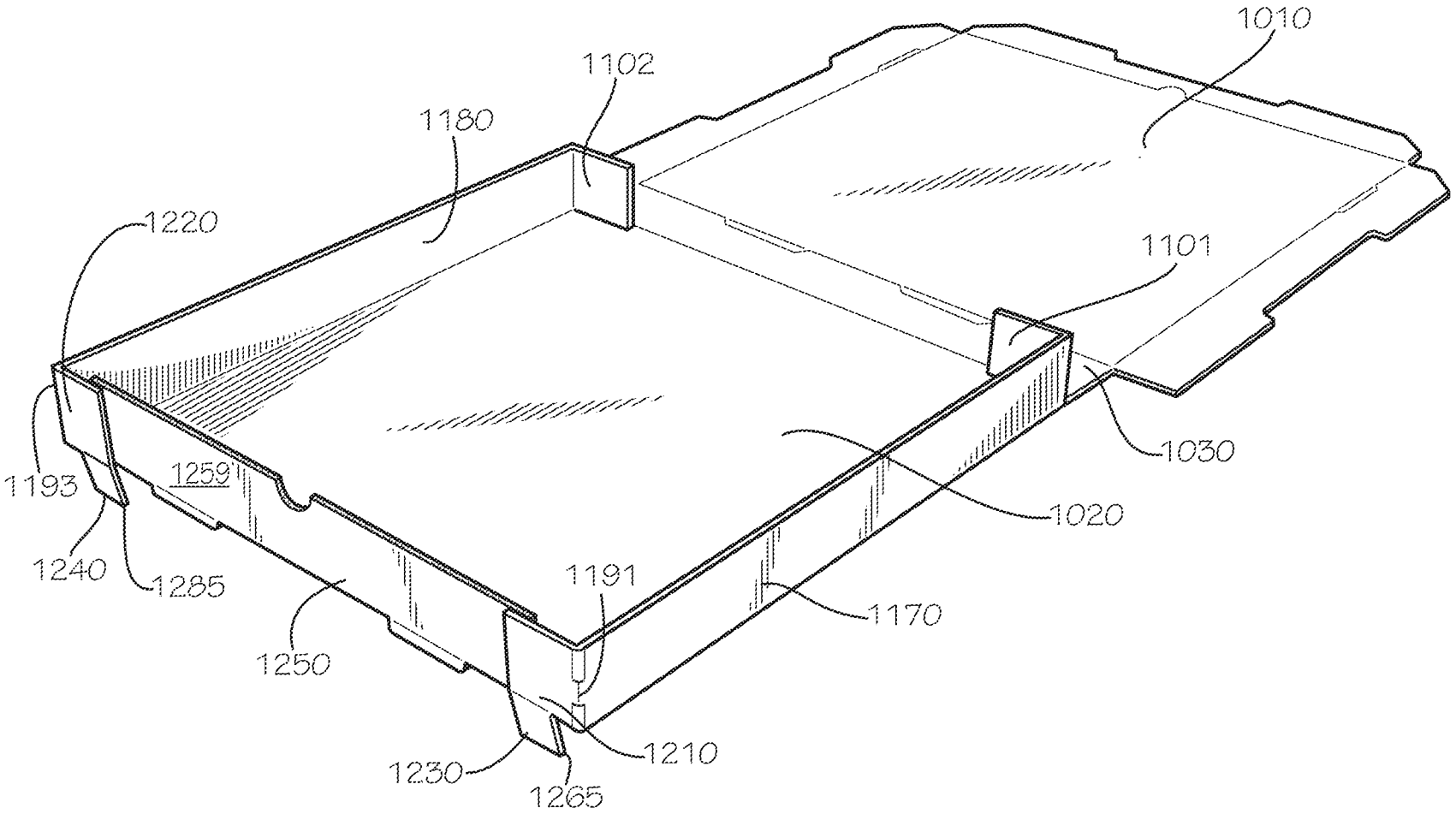
FIG. 5 is a perspective view of the formation of a box from the blank of FIG. 1 in accord with one aspect of the current disclosure.

As seen with reference to FIG. 5, cover tabs 1210, 1220 are folded along scorelines 1191, 1193 such that contact surfaces 1212, 1222 (shown with reference to FIG. 2) are in contact with an outer surface 1259 of the bottom front tab 1250. Connection tabs 1230, 1240 are shown extended below the bottom 1020 in preparation of folding.

When folded, the connection tabs 1230, 1240 are inserted into the connection apertures 1330, 1340, respectively. Ends 1265, 1285 of the connections tabs 1230, 1240 are of larger linear dimensions than the width of the connection apertures 1330, 1340, meaning that the connection tabs 1230, 1240 are of a slight interference fit with respect to connection apertures 1330, 1340 along the ends 1265, 1285. As a result, when the connection tabs 1230, 1240 are inserted into the connection apertures 1330, 1340, the force required to insert them may slightly bend the material—in the current aspect, corrugated cardboard—when inserting. In the current aspect, the bend is intended to be within the elastic bending region and not intended to cause permanent deformation of either the connection tabs 1230, 1240 or of the connection apertures 1330, 1340. When the connection tabs 1230, 1240 are inserted past the connection apertures 1330, 1340, the ends 1265, 1285 will spring back into their original shape, resulting in the connection of the connection tabs 1230, 1240 with the bottom 1020.

Because the connection tabs 1230, 1240 are bent around the bottom front tab 1250, the radius 1271, 1291 of each connection tab 1230, 1240 provides additional strength to help reduce the possibility that a stress concentration results in shearing of the connection tabs 1230, 1240 from the cover tabs 1210, 1220. Because corrugated cardboard is deformed as it is bent around the bottom front tab 1250, the connection tabs 1230, 1240 can have shape memory that causes them to behave in a manner similar to a leaf spring. As such, the shape memory of the connection tabs 1230, 1240 can help them stay engaged against the bottom 1020 as the connection tabs 1230, 1240 remain inserted into connection apertures 1330, 1340.

When the connection tabs 1230, 1240 are inserted into the connection apertures 1330, 1340, aperture covers 1360, 1380 are dislocated. In various aspects, the aperture covers 1360, 1380 can fold in behind the connection tabs 1230, 1240 and provide a backing support to the connection tabs 1230, 1240 to maintain engagement. In various aspects, the aperture covers 1360, 1380 can be omitted. The aperture covers 1360, 1380 can also provide a cover for the bottom 1020 to minimize the size and amount of holes in the bottom 1020, as additional holes in the bottom 1020 may prove undesirable as contents of the assembled box may leak out.

Figure 6:
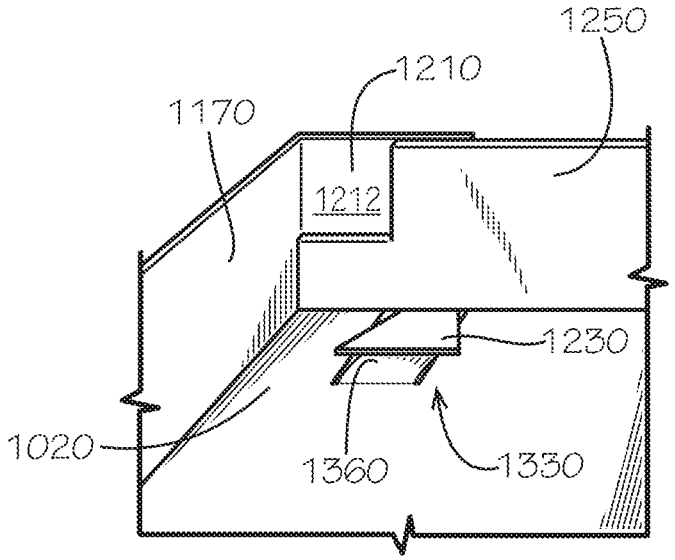
FIG. 6 is a detail view of a connection system as utilized in the formation of a box from the blank of FIG. 1 in accord with one aspect of the current disclosure.

As seen with reference to FIG. 6, the connection between first connection tab 1230 and bottom 1020 comprises the first connection tab 1230 pushed through the first connection aperture 1330 with aperture cover 1360 covering the first connection aperture 1330 behind the first connection tab 1230. It would be understood that the connection between the second connection tab 1240 and the bottom 1020 would be of similar arrangement.

One of skill in the art would understand that the connection described with reference to FIGS. 5-6 are but one aspect in a disclosure that contemplates many connection arrangements. As such, it should not be considered as limiting on the disclosure that one specific connection arrangement is shown and described, as various connection arrangements can be utilized without straying from the scope of the current disclosure.

Figure 7:
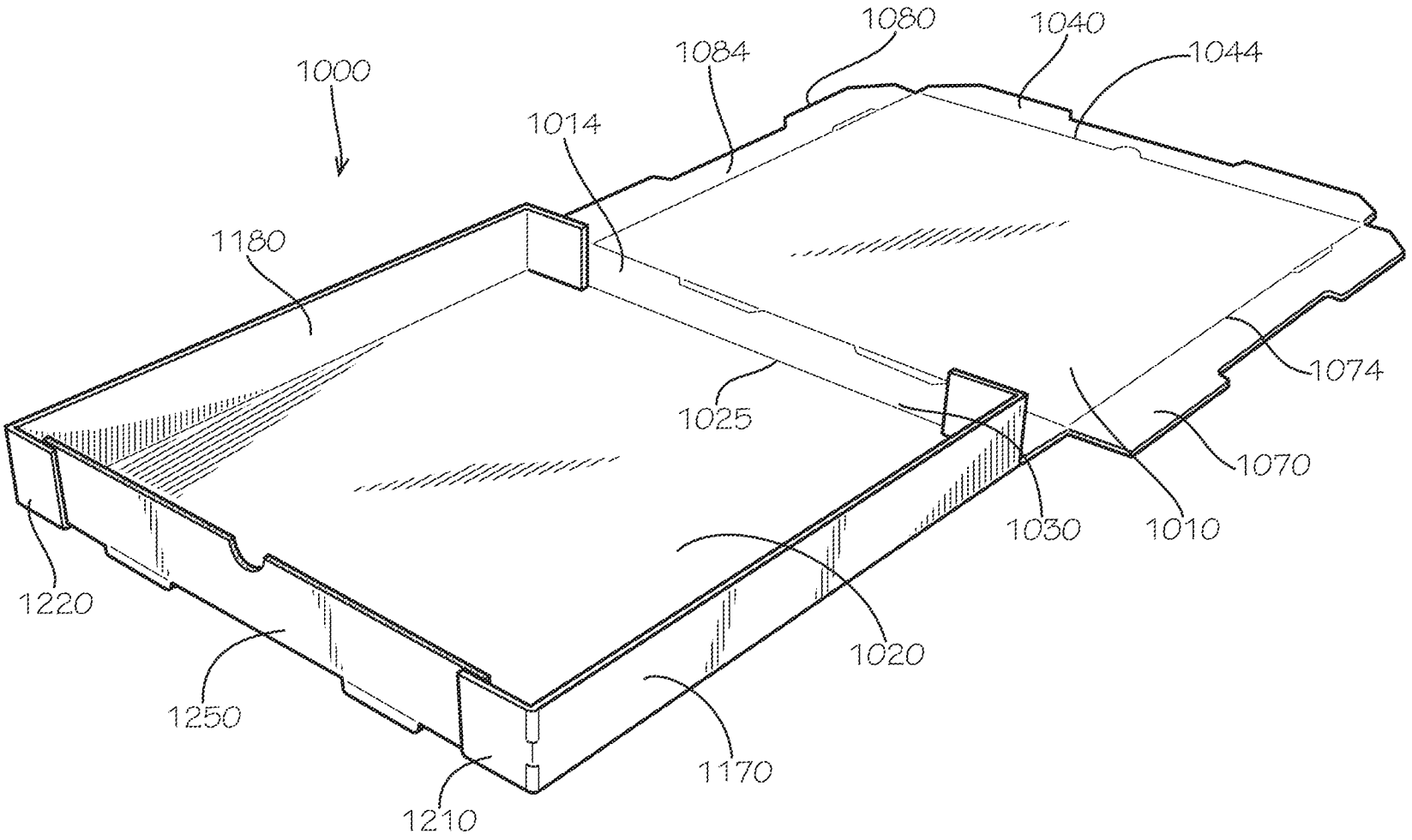
FIG. 7 is a perspective view of the formation of a box from the blank of FIG. 1 in accord with one aspect of the current disclosure.

As seen with reference to FIG. 7, the blank 1000 can be arranged and secured with all portions that are connected to the bottom 1020 in fully engaged arrangement. As such, the top 1010 can be folded along score line 1014. The top front tab 1040 can be folded along score line 1044, and each side tab 1070, 1080 can be folded with respect to the top 1010 along its respective scoreline 1074, 1084. Once the portions connected to the top 1010 are arranged, the top 1010 can be additionally folded with respect to the back connection side 1030 along scoreline 1014 and the back connection side 1030 can be folded with respect to the bottom 1020 along scoreline 1025.

Figure 8:
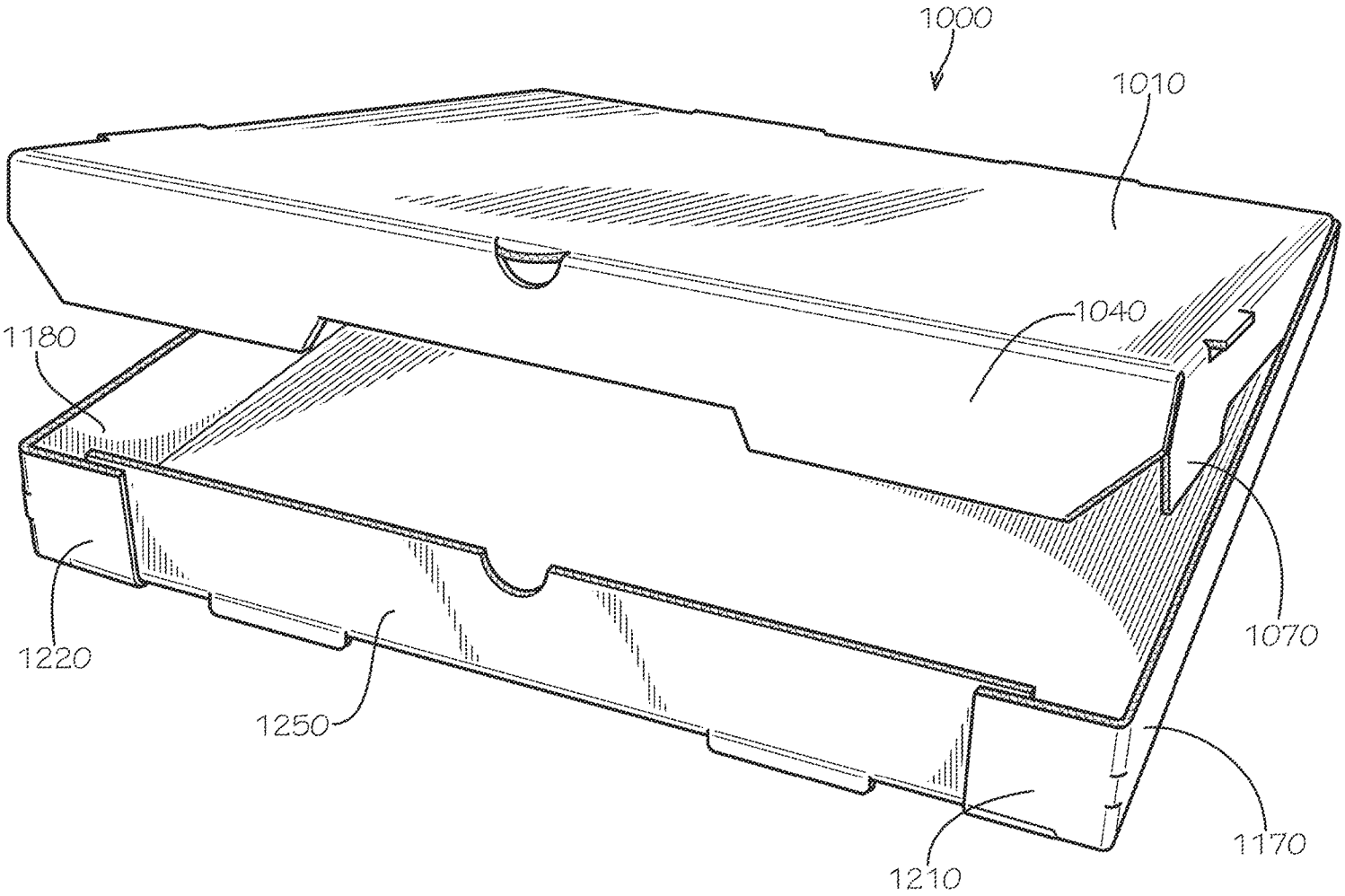
FIG. 8 is a perspective view of the formation of a box from the blank of FIG. 1 in accord with one aspect of the current disclosure.

As seen with reference to FIG. 8, the top front tab 1040 can be folded behind the bottom front tab 1250. The first side tab 1070 can be folded behind the first side tab 1170. The second side tab 1080 can be folded behind the second side tab 1180. As such, the blank 1000 can form a box with a clamshell type arrangement.

Figure 9:
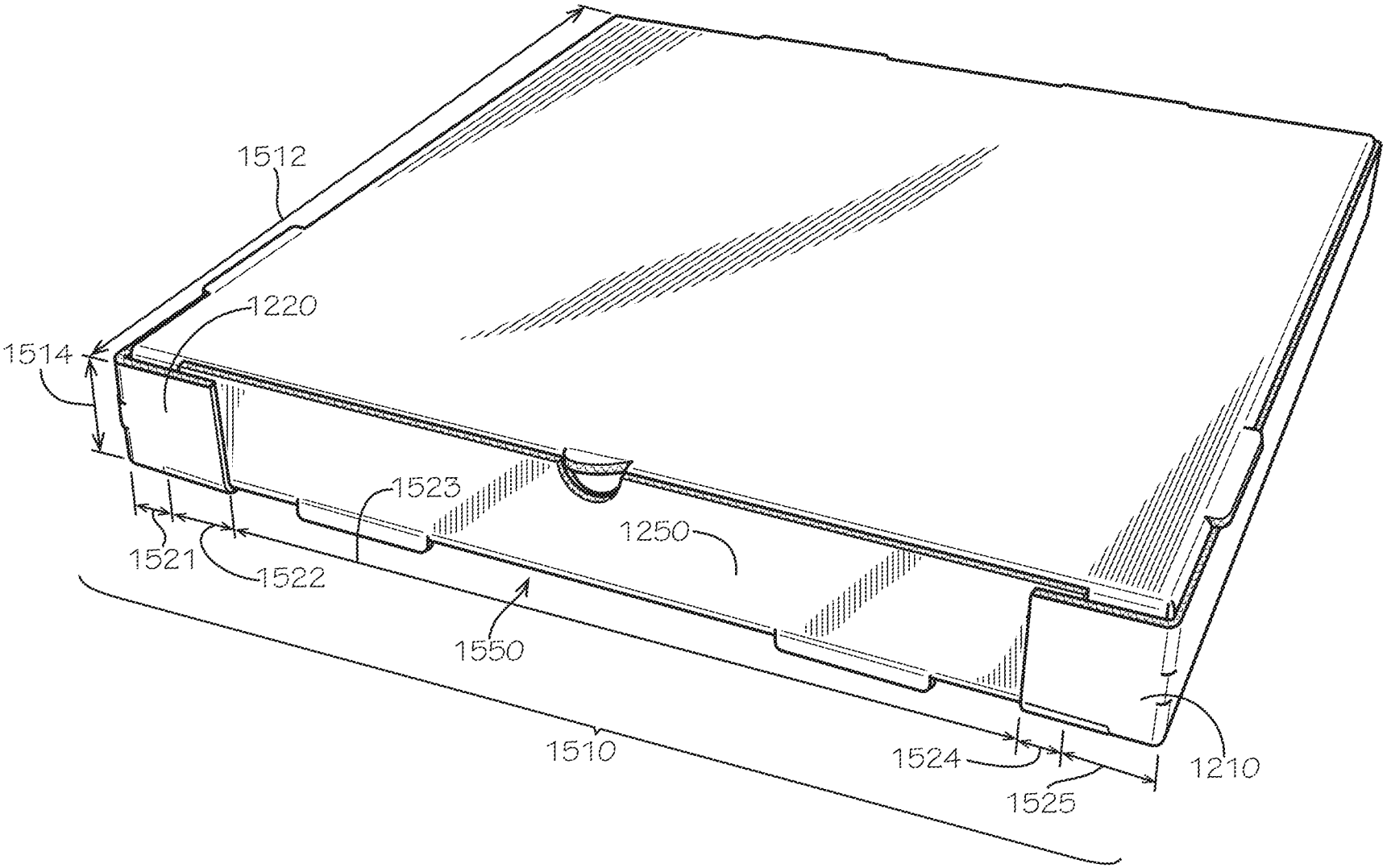
FIG. 9 is a perspective view of the formation of a box from the blank of FIG. 1 in accord with one aspect of the current disclosure.

As seen with reference to FIG. 9 the resultant pizza box formed of blank 1000 includes a width 1510 defined as the lateral extent of the pizza box, a length 1512 defined as the lateral extent of the pizza box orthogonal to the width 1510, and a height 1514 defined as the vertical extent of the pizza box orthogonal to the width 1510 and the length 1512. As can be seen, the width 1510 comprises a first portion 1521, a second portion 1522, a third portion 1523, a fourth portion 1524, and a fifth portion 1525. Of the five portions of the width 1510 in the current aspect, only the second portion 1522 and the fourth portion 1524 comprise more than 2-ply of corrugated cardboard (1-ply from the top front tab 1040 and 1-ply from the bottom front tab 1250) within their thickness as measured parallel to the length 1515 for an entirety of the height 1514. In other words, with respect to the bottom front tab 1250 and its interaction with the cover tabs 1210, 1220, the only overlap of the bottom front tab 1250 with the cover tabs 1210, 1220 occurs in the first portion 1521, second portion 1522, fourth portion 1524, and fifth portion 1525. Additionally, within the first portion 1521 and the fifth portion 1525, the overlap of the cover tabs 1210, 1220 with the bottom front tab 1250 occurs only for about half the height 1514. As such, when compared to some other pizza box designs, the material requirements for forming a front side 1550 of the pizza box formed of blank 1000 are greatly reduced because material does not significantly overlap.

In yet another method of defining part of the benefit of the current aspect, it can be understood that the front side 1550 of the current aspect is of rectangular facing having a dimension of about 2 inches in high (height 1514) by about 16 inches in wide (width 1510). As such, a facing of 32 square inches defines the area of the front side 1550. Of that front side 1550, the cover tabs 1210, 1220 overlap the bottom front tab 1250 for about 6 square inches, or only about 18.75% of the square area.

Additionally, the bottom front tab 1250 is about 30 square inches in area. It is contacted by the cover tabs 1210, 1220 for only about 6 square inches of area, or only about 20% of the square area. It is noted that, in the current aspect, the top front tab 1040 contacts the bottom front tab 1250 on an inner side of the bottom front tab 1250.

For the above area overlap calculations, the top front tab 1040 was not considered. Ignoring the top front tab 1040, the "overlap" of surfaces creates a 2-ply area of thickness. As such—while ignoring the top front tab 1040—there is only about 6 square inches if 2-ply thickness to the pizza box formed of blank 1000 in the current aspect.

Yet another way of defining the benefit is to determine an initial area ratio ($R_A^i$) the total area of material sitting to the area projected to be front side 1550. For example, if only 1-ply of material covered the entire front side 1550, then the ratio of total material to projected area ("area ratio," $R_A^i$) would be 1.0. If the area were 2-ply of material covering the entire front side 1550, then the $R_A^i$ would be 2.0. If half of the area were covered in 1-ply and half were covered in 2-ply, then the $R_A^i$ would be 1.5. In the current aspect disclosed of pizza box formed from blank 1000, the $R_A^i$ would be determined by understanding the area of the front side 1550 as the dominator and the area of all material projected along the front side 1550 as the numerator. As such, the $R_A^i$ would be 38 square inches divided by 32 square inches, or about 1.18.

For the calculations defined above, rough numbers were utilized—notably rounding off the dimensions to nearest round number and ignoring small fractional amounts, which could lead to slightly different results. As such, the area overlaps and ranges cited are estimates and could be slightly different for the current aspect. Ranges can be notably different for varying aspects.

Including the profile of the top front tab 1040 can result in different understandings of the benefit. For example, when including the top front tab 1040 in the calculation of an area ratio ($R_A$), a slightly different number would be resulted. The top front tab 1040 includes angles 1057*a,b* that together define about 1 square inch in the current aspect. Additionally, the recessed portion 1054 is a cutout of about 6 inches in length and ½ inches in depth, resulting in an additional about 3 square inches of material removal. When quantifying the $R_A$, the numerator would include this area (about 28 square inches) along with the area previously noted for the front side 1550 when ignoring the top front tab 1040, $R_A^i$, which was about 38 square inches. As a result, the $R_A$ would be about (38+28)/32=2.06, or about 2. As such, the material requirements for forming the pizza box from blank 1000 are significantly less than other similar packing products.

In various aspects, $R_A$ could range up to and include 2.25. In various aspects, $R_A$ could range up to and include 2.5. In various aspects, $R_A$ could range up to and include 2.75. In various aspects, $R_A$ could range up to and include 3.0. In various aspects, the overlap could be up to 20%. In various aspects, the overlap could be up to 25%. In various aspects, the overlap could be up to 30%. In various aspects, the 2-ply area ignoring the top front tab 1040 could be up to 20%. In various aspects, the 2-ply area ignoring the top front tab 1040 could be up to 25%. In various aspects, the 2-ply area ignoring the top front tab 1040 could be up to 30%.

Additionally, utilizing the initial area ratio $R_A^i$ or the area ratio $R_A$, an area density ($\rho_A$) can be arrived upon by dividing the $R_A^i$ or $R_A$ by the number of plies considered within the calculation of $R_A^i$ or $R_A$. As such, calculating $\rho_A$ in the example above with $R_A^i$, =1.18 when a 2-ply section is considered yields $\rho_A$ of 0.59. In the same example above, when considering 3-ply section (i.e., including the top front tab 1040) starts with a $R_A$=2.06 and results in a $\rho_A$ of 0.69 (2.06 divided by 3 is about 0.69).

Figure 10:
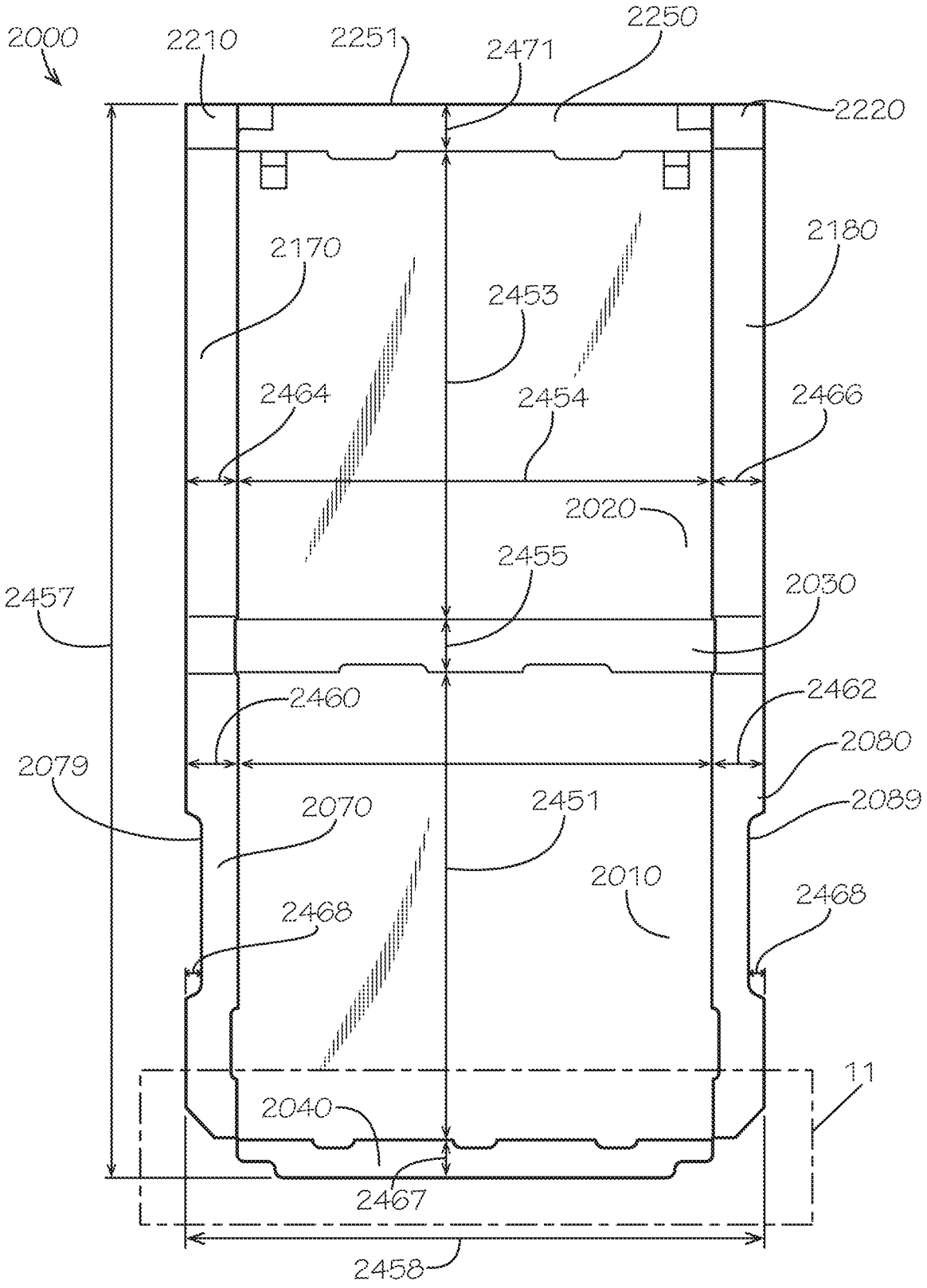
FIG. 10 is a plan view of a blank for forming a box in accord with one aspect of the current disclosure.

Another aspect of a blank 2000 is disclosed with reference to FIG. 10. The blank 2000 can comprise a top 2010, a bottom 2020, and a back connection side 2030. Elements of the blank 2000 that are similarly drawn to blank 1000 should be considered of similar size and shape unless noted otherwise.

Measurements of various portions of the blank 2000 are described. The various measurements are provided for reference and are not intended to be limiting on the scope of the disclosure. A length 2451 of the top 2010 is disclosed; in the current aspect, the length 2451 is 16 and 1/16 inches. A width 2452 of the top 2010 is disclosed; in the current aspect, the width 2452 is 16 and 1/16 inches. A length 2453 of the bottom 2020 is disclosed; in the current aspect, the length 2453 is 16 and 3/16 inches. A width 2454 of the bottom 2020 is disclosed; in the current aspect, the width 2454 is 16 and 3/16 inches. A length 2455 of the back connection side 2030 is disclosed; in the current aspect, the length 2455 is 1 and 7/8 inches. A width of the back connection side 2030 could be about the same as the width 2452 or the width 2454 or could be larger or smaller depending on the aspect. An overall length 2457 of the blank 2000 is disclosed; in the current aspect, the overall length is 36 and 15/16 inches. An overall width 2458 is disclosed; in the current aspect, the overall width 2458 is 20 and 1/8 inches. A width 2460 of a first side tab 2070 is disclosed; in the current aspect, the width 2460 is 1 and 3/4 inches. A width 2462 of a second side tab 2080 is disclosed; in the current aspect, the width 2462 is 1 and 3/4 inches. A width 2464 of a first side tab 2170 is disclosed; in the current aspect, the width 2464 is 1 and 11/16 inches. A width 2466 of the second side tab 2180 is disclosed; in the current aspect, the width 2466 is 1 and 11/16 inches. A length 2467 of a top front tab 2040 is disclosed; in the current aspect, the length 2467 is 1 and 1/4 inches. A depth 2468 of recessed portions 2079, 2089 is disclosed; in the current aspect, both recessed portions 2079, 2089 are the same depth 2468 at 1/2 inches. A bottom front tab 2250 is shown including an end 2251. First cover portion 2210 and second cover portion 2220 can also be seen.

Figure 11:
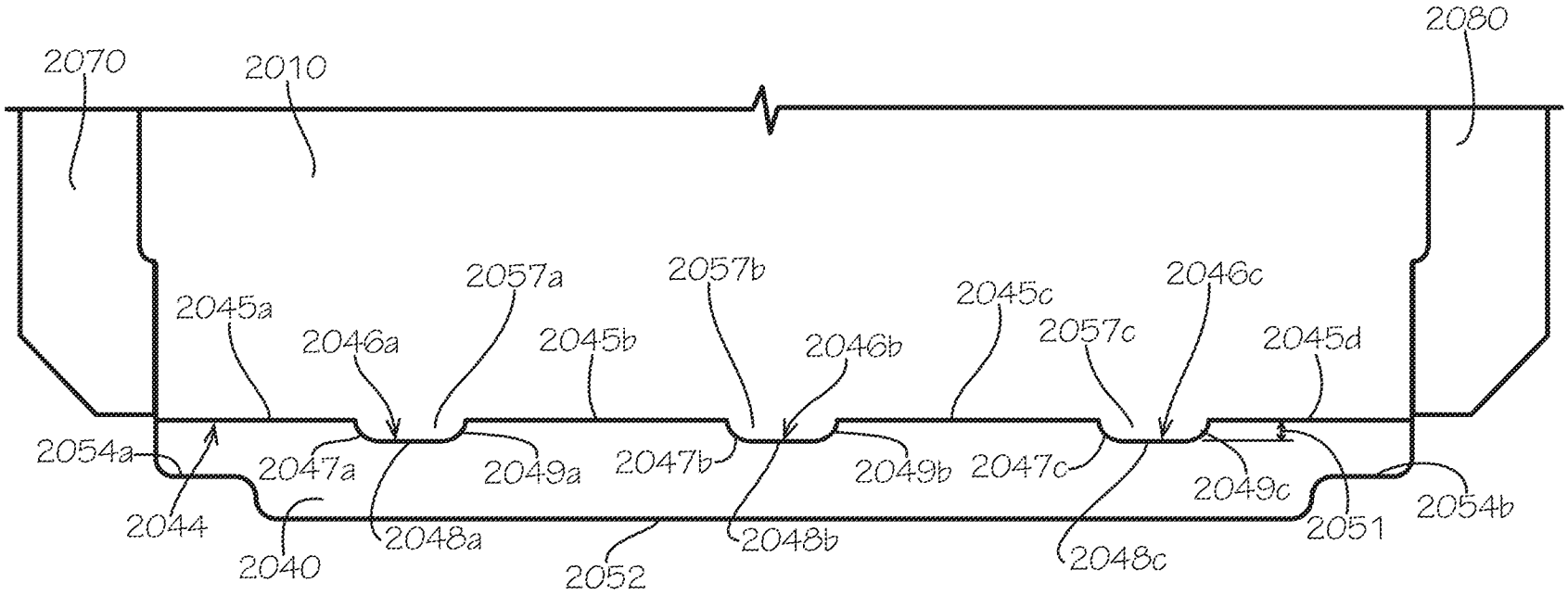
FIG. 11 is a detail view of Detail 11 as annotated in FIG. 10.

As seen with reference to FIG. 11, the top front tab 2040 is connected to the top 2010 along a scoreline 2044. The scoreline 2044 can comprise four score portions 2045*a,b,c,d* and three cut portions 2046*a,b,c*. Each cut portion 2046*a,b,c* can comprise a first radius portion 2047*a,b,c*, a second radius portion 2049*a,b,c*, and a linear portion 2048*a,b,c* connecting the first radius portion 2047*a,b,c* to the second radius portion 2049*a,b,c*. Although the shape of each cut portion 2046*a,b,c* is the same in the current aspect, various aspects may include various shapes that need not be the consistent amongst the various cut portions 2046*a,b,c*. Additionally, cut portions 2046*a,b,c* need not be of the shape cited, as any similar shape of similar structural integrity can perform similarly. The linear portions 2048*a,b,c* of the cut portions 2046*a,b,c* can extend beyond the score portions 2045*a,b,c,d* by a distance 2051. The distance 2051 is about 3/8 of an inch, and in various aspects can be as little as 3/16 of an inch and as great as 1/2 of an inch. The cut portions 2046*a,b,c* define tabs 2057*a,b,c*.

The top front tab 2040 can comprise an end 2052. The end 2052 can comprise recessed portions 2054*a,b*. In the current aspect, the recessed portions 2054*a,b* are simple rectangular recesses with radiused corners. The recessed portions 2054*a,b* can allow for easier folding of the box resultant from blank 2000 and also provide for a reduction of material usage. The radiused corners can reduce stress concentrations that might compromise the structural integrity of the resultant box. In the current aspect, each recessed portion 2054*a,b* is of about 1/2 inch in height and about 1 inch in length.

Dimensions of the blanks 1000, 2000 are similar in many places, but specific examples can be called out to illustrate differences in the blanks 1000, 2000. For example, the blank 2000 can be contrasted with blank 1000 along the comparison between top front tab 2040 and 1040. Length 1467 was previously noted as being of an exemplary length of two inches, but length 2467 is of a length of only 1 and 1/4 inches. The result is a top front tab 2040 that is of significantly reduced material usage than top front tab 1040. However, end 1052 contacts the bottom 1020 when the box is formed from the blank 1000. Because the length 2467 is much less than the length 2471, end 2052 in the current aspect does not contact the bottom 2020 when the box is formed from the blank 2000. Because the box formed from blank 2000 could collapse, the box formed from blank 2000 comprises tabs 2057*a,b,c* that contact end 2251 to prevent collapse.

The mechanism of connecting the bottom front tab 2250 to the bottom 2020 can be similar to that previously discussed, and, as such, the overlap would be of similar dimensions with respect to the bottom 2020 and ignoring the top front tab 2040. However, additional benefits can be discussed with respect to the top front tab 2040. For example, $R_A$ can be calculated with respect to the top front tab 2040 included. In the current aspect, the bottom front tab 2250 and the cover portions 2210, 2220 make up an area of about 38 square inches; additionally, top front tab 2040 is of an area of about 19 square inches (about 1.25 inches multiplied by about 16 inches and then subtracting the recessed portions 2054*a,b*, which together are about 1 square inch). Thus, the area ratio $R_A$ can be calculated as 57 square inches in the numerator and 32 square inches in the denominator, resulting in $R_A$=1.78, or about 1.75. Additionally, the area density ($\rho_A$) can be determined by dividing $R_A$ by the number of plies, resulting in a $\rho_A$ of 0.59 (1.78 divided by 3 is about 0.59).

Area densities ($\rho_A$) ranging up to 0.75 can be considered of great benefit from the standpoint of material reduction. Area densities ($\rho_A$) ranging up to 1.0 can also be considered beneficial. Area densities ($\rho_A$) up to 1.25 for 3-ply consideration can be considered within the scope of the disclosure and are enabled with various modifications to various aspects of the current disclosure.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A blank comprising:

a top, the top connected to a first top side tab, a second top side tab, a top front tab, and a back tab; and a bottom, the bottom defining a connection aperture, the bottom connected to a first bottom side tab, a second bottom side tab, a bottom front tab, and the back tab;

the first bottom side tab connected to a first cover tab, the first cover tab connected to a first connection tab;

the second bottom side tab connected to a second cover tab, the second cover tab connected to a second connection tab;

the blank formable into a box by connection of the first connection tab to the connection aperture, wherein an end of the first connection tab is of a width greater than a width of the connection aperture.

2. The blank of claim 1, the bottom further comprising an aperture cover at least partially covering the connection aperture.

3. The blank of claim 1, wherein a portion of the first connection tab proximate the first cover tab is of a smaller width than the end of the first connection tab, and wherein a portion of the second connection tab proximate the second cover tab is of a smaller width than the end of the second connection tab.

4. The blank of claim 3, wherein a portion of the first connection tab proximate the first cover tab defines a radius, and wherein a portion of the second connection tab proximate the second cover tab defines a radius.

5. The blank of claim 1, wherein the top front tab is of a length that is less than a length of the bottom front tab.

6. The blank of claim 5, wherein the length of the top front tap is at most 75% of the length of the bottom front tab.

7. The blank of claim 5, wherein the top front tab comprises at least 3 tabs, each tab arrangeable to contact an end of the bottom front tab.

8. A box comprising:

a top, the top connected to a first top side tab, a second top side tab, a top front tab, and a back tab;

a bottom, the bottom, the bottom connected to a first bottom side tab, a second bottom side tab, a bottom front tab, and the back tab, the back tab defining a back side of the box, the bottom front tab contacting the top front tab defining a front side of the box, the first bottom side tab contacting the first top side tab defining a first side of the box, the second bottom side tab contacting the second top side tab defining a second side of the box;

a connection mechanism defined proximate the front side of the box, the connection mechanism comprising an overlap of material along the front side of the box, wherein the front side of the box defines a length and wherein the front side of the box is not greater than two-ply along at least 70% of the length.

9. The box of claim 8, wherein the material along the front side of the box defines an area ratio $R_A$ wherein $R_A$ is at most 2.50.

10. The box of claim 9, wherein $R_A$ is at most 2.00.

11. The box of claim 9, wherein $R_A$ is at most about 1.75.

12. The box of claim 9, wherein $R_A$ is at most 2.25.

13. The box of claim 8, wherein the front side of the box defines a length and wherein the front side of the box is not greater than two-ply along at least 75% of the length.

14. The box of claim 8, wherein the front side of the box defines a length and wherein the front side of the box is not greater than two-ply along at least 78% of the length.

15. The box of claim 8, wherein the front side of the box defines an area density $\rho_A$ and wherein $\rho_A$ is less than 0.70.

16. The box of claim 8, wherein the front side of the box defines an area density $\rho_A$ and wherein $\rho_A$ is less than 0.60.

17. The blank of claim 1, wherein an initial area ratio $R_A^i$ is the area of the first cover tab, the second cover tab, and the bottom front tab divided by the area of the front side, and wherein the initial area ratio $R_A^i$ is not greater than 1.2.

18. A box comprising:

a top, the top connected to a first top side tab, a second top side tab, a top front tab, and a back tab;

a bottom, the bottom, the bottom connected to a first bottom side tab, a second bottom side tab, a bottom front tab, and the back tab, the back tab defining a back side of the box, the bottom front tab contacting the top front tab defining a front side of the box, the first bottom side tab contacting the first top side tab defining a first side of the box, the second bottom side tab contacting the second top side tab defining a second side of the box;

a connection mechanism defined proximate the front side of the box, the connection mechanism comprising an overlap of material along the front side of the box, wherein the front side of the box defines an area density $\rho_A$ and wherein $\rho_A$ is less than 0.70.

19. The box of claim 18, wherein the area density $\rho_A$ of the front side of the box is less than 0.60.

20. A blank comprising:

a top, the top connected to a first top side tab, a second top side tab, a top front tab, and a back tab; and a bottom, the bottom defining a connection aperture, the bottom connected to a first bottom side tab, a second bottom side tab, a bottom front tab, and the back tab;

the first bottom side tab connected to a first cover tab, the first cover tab connected to a first connection tab;

the second bottom side tab connected to a second cover tab, the second cover tab connected to a second connection tab;

the blank formable into a box by connection of the first connection tab to the connection aperture, wherein an initial area ratio $R_A^i$ is the area of the first cover tab, the second cover tab, and the bottom front tab divided by the area of the front side, and wherein the initial area ratio $R_A^i$ is not greater than 1.2.

* * * * *